US008296906B2

(12) United States Patent
Wisniewski

(10) Patent No.: US 8,296,906 B2
(45) Date of Patent: Oct. 30, 2012

(54) FOUR BAR HINGE

(75) Inventor: Michael G. Wisniewski, North East, PA (US)

(73) Assignee: Weber Knapp Company, Jamestown, NY (US)

( * ) Notice: Subject to any disclaimer, the term of this patent is extended or adjusted under 35 U.S.C. 154(b) by 372 days.

(21) Appl. No.: 12/431,009

(22) Filed: Apr. 28, 2009

(65) Prior Publication Data

US 2010/0269293 A1 Oct. 28, 2010

(51) Int. Cl.
*E05D 15/32* (2006.01)

(52) U.S. Cl. ..... 16/370; 16/250; 16/368; 16/281; 16/284; 16/302

(58) Field of Classification Search ..... 16/370, 16/368, 369, 277, 281, 282, 284, 285, 286, 16/287, 302, 235, 249, 366, 250, 251; 312/405, 312/223.1, 223.2, 223.3; 49/381
See application file for complete search history.

(56) References Cited

U.S. PATENT DOCUMENTS

| | | | | |
|---|---|---|---|---|
| 4,736,491 | A * | 4/1988 | Mertes | 16/358 |
| 5,497,534 | A | 3/1996 | Caruso | |
| 5,791,016 | A * | 8/1998 | Lenz | 16/258 |
| 6,308,376 | B1 * | 10/2001 | Koshikawa | 16/250 |
| 6,557,210 | B2 * | 5/2003 | Kincaid | 16/250 |
| 6,618,904 | B1 * | 9/2003 | Nagy | 16/370 |
| 6,845,545 | B2 | 1/2005 | Han et al. | |
| 6,892,423 | B2 * | 5/2005 | Cheal et al. | 16/289 |
| 7,469,447 | B2 * | 12/2008 | Schlegel | 16/366 |
| 7,987,558 | B2 * | 8/2011 | Beckmann et al. | 16/366 |
| 2003/0009850 | A1 * | 1/2003 | Kincaid | 16/250 |
| 2003/0056330 | A1 * | 3/2003 | Westerdale | 16/370 |
| 2004/0088826 | A1 * | 5/2004 | Schlegel | 16/366 |
| 2005/0264029 | A1 * | 12/2005 | Bodner | 296/146.8 |
| 2008/0120807 | A1 | 5/2008 | Heger et al. | |
| 2008/0276422 | A1 * | 11/2008 | Beckmann et al. | 16/258 |
| 2009/0064463 | A1 | 3/2009 | Gomoll et al. | |

FOREIGN PATENT DOCUMENTS

| | | |
|---|---|---|
| WO | WO 2006/082175 | 8/2006 |
| WO | WO 2006/114255 | 11/2006 |
| WO | WO 2006/120105 | 11/2006 |

* cited by examiner

*Primary Examiner* — Victor Batson
*Assistant Examiner* — Emily Morgan
(74) *Attorney, Agent, or Firm* — Simpson & Simpson, PLLC

(57) ABSTRACT

A four bar hinge for mounting a door on an enclosure, the hinge including a first mounting bracket adapted to secure the hinge to the enclosure, a second mounting bracket adapted to secure the hinge to the door, a first link rotationally connected to the first mounting bracket at a first location and rotationally connected to the second mounting bracket at a second location, a second link rotationally connected to the first mounting bracket at a third location and rotationally connected to the second mounting bracket at a fourth location, a first shield fixedly connected at the second and the fourth locations and a second shield slidably connected to the first link and rotationally connected at the third location, wherein throughout an entire range of motion of the first mounting bracket relative to the second mounting bracket at least a portion of one of the first or second shields overlaps at least a portion of the other of the first and second shields whereby access to a volume formed between the first and second links is precluded.

15 Claims, 9 Drawing Sheets

FOUR BAR HINGE

FIELD OF THE INVENTION

The invention broadly relates to hinges, more specifically to hinges for use in appliances and cabinetry, and even more particularly to a four bar hinge for use in appliances and cabinetry including features which increase the safety and functionality of the hinge.

BACKGROUND OF THE INVENTION

Hinges, and in particular, hinges used with appliances and cabinetry take a variety of forms and arrangements. In view of modern kitchen designs, such hinges must be capable of supporting increasingly heavier doors and must also be capable of both translational and rotational movement. For example, some refrigerators are positioned within a set of cabinets such that in order to obtain access to the interior, the door must move out away from the adjacent cabinets and rotate to a position equal to or greater than ninety degrees open. Similarly, cabinet doors, oven doors and other appliances, e.g., dishwashers, benefit from hinges that are capable of the foregoing translational and rotational movement. Additionally, as these appliances are increasing in size, suitable hinges must also be capable of supporting greater weights than in the past.

A common form of such hinges includes a complex and expensive arrangement of linkages configured in such a way as to permit the necessary translational and rotational movement while being capable of supporting the necessary weight. Examples of such hinges can be found in International Patent Application Nos. PCT/EP2006/003742 and PCT/EP2006/061438. The foregoing linkage arrangements suffer from several defects, including but not limited to being difficult to modify the characteristic of the biasing forces. In short, the lengths of links and their respective pivot point positions must be modified in order to modify where and how much biasing forces are present. It should be appreciated that "biasing forces," as used herein, is intended to mean the opening and closing forces present within a hinge when its various moving members are located in particular positions.

Due to the large range of motion hinges of the foregoing type must traverse, large openings may be created wherein an unsuspecting operator of a hinge may place her fingers and subsequently sustain an injury upon the closing of the door to which the hinge is attached. Thus, hinge designs have grown to incorporate shielding means to protect from such injuries. For example, International Patent Application No. PCT/EP2006/050531 teaches a single shield design arranged to prevent the insertion of an object, e.g., a child's finger, within the clamping linkages of the hinge. Such shielding, when present, has heretofore suffered from defects, such as binding open operation of the hinge and generally obtrusive appearances.

As can be derived from the variety of devices and methods directed at positioning a door on an enclosure and permitting the translational and rotational movement of such doors, many means have been contemplated to accomplish the desired end, i.e., reliable, controlled movement of the door relative to the enclosure. Heretofore, tradeoffs between strength, safety and functionality were required. Thus, there is a long-felt need for a hinge which both translates and rotates and includes an easily modifiable arrangement of providing biasing forces. There is a further long-felt need for a hinge having a shielding means that protects against the insertion of objects within the hinge mechanism throughout the hinge's entire range of motion.

BRIEF SUMMARY OF THE INVENTION

The present invention broadly comprises a four bar hinge for mounting a door on an enclosure. The inventive hinge includes a first mounting bracket adapted to secure the hinge to the enclosure, a second mounting bracket adapted to secure the hinge to the door, a first link rotationally connected to the first mounting bracket at a first location and rotationally connected to the second mounting bracket at a second location and a second link rotationally connected to the first mounting bracket at a third location and rotationally connected to the second mounting bracket at a fourth location. The present invention further includes a first shield fixedly connected at the second and the fourth locations and a second shield slidably connected to the first link and rotationally connected at the third location. In this embodiment of the present invention hinge, throughout an entire range of motion of the first mounting bracket relative to the second mounting bracket, at least a portion of one of the first or second shields overlaps at least a portion of the other of the first and second shields whereby access to a volume formed between the first and second links is precluded.

In some embodiments, the present invention further includes a cam integral to the second link, the cam having a first curved portion and a second curved portion, wherein the first curved portion includes a first curvature, the second curved portion includes a second curvature and the first and second curvatures form a continuous surface. In these embodiments, the present invention still further includes a roller biased against the cam thereby imparting a force against the cam and maintaining contact with the cam throughout the entire range of motion of the first mounting bracket relative to the second mounting bracket. In some of these embodiments, the first curvature is substantially the same as the second curvature, while in others of these embodiments, the first curvature is different than the second curvature. In yet others of these embodiments, the present invention further includes a rocker arm rotationally connected to the first mounting bracket at a fifth location and a spring having a first end rotationally connected to the first mounting bracket at a sixth location and a second end rotationally connected to the rocker arm at a seventh location. In these embodiments, the roller is rotationally connected within the rocker arm at an eighth location and the spring is arranged to bias the roller against the cam. In some of these embodiments, the seventh and eighth locations are positionally different. Furthermore, in other embodiments, the cam is arranged adjacent to the third location and a direction of the force is substantially radial relative to the third location.

Moreover, in some embodiments, the first shield includes an edge having at least one first curvature and/or the second shield includes an edge having at least one second curvature.

In a further embodiment, the present invention broadly comprises a four bar hinge for mounting a door on an enclosure. The hinge includes a first mounting bracket adapted to secure the hinge to the enclosure, a second mounting bracket adapted to secure the hinge to the door, a first link rotationally connected to the first mounting bracket at a first location and rotationally connected to the second mounting bracket at a second location and a second link having a cam, the second link rotationally connected to the first mounting bracket at a third location and rotationally connected to the second mounting bracket at a fourth location. In this embodiment, the cam includes a first curved portion and a second curved portion, wherein the first curved portion has a first curvature, the second curved portion has a second curvature and the first and second curvatures form a continuous surface. Moreover, in this embodiment, the hinge further includes a roller biased against the cam thereby imparting a force against the cam and maintaining contact with the cam throughout an entire range of motion of the first mounting bracket relative to the second mounting bracket.

In some embodiments, the first curvature is substantially the same as the second curvature, while in other embodiments, the first curvature is different than the second curvature. In yet other embodiments, the hinge further includes a rocker arm rotationally connected to the first mounting bracket at a fifth location and a spring having a first end rotationally connected to the first mounting bracket at a sixth location and a second end rotationally connected to the rocker arm at a seventh location, wherein the roller is rotationally connected within the rocker arm at an eighth location and the spring is arranged to bias the roller against the cam. In some of these embodiments, the seventh and eighth locations are positionally different.

In still yet other embodiments the cam is arranged adjacent to the third location and a direction of the force is substantially radial relative to the third location. In other embodiments, the present invention four bar hinge further includes a first shield fixedly connected at the second and the fourth locations and a second shield slidably connected to the first link and rotationally connected at the third location, wherein throughout an entire range of motion of the first mounting bracket relative to the second mounting bracket at least a portion of one of the first or second shields overlaps at least a portion of the other of the first and second shields whereby access to a volume formed between the first and second links is precluded. In some of these embodiments, the first shield includes an edge having at least one first curvature, the second shield includes an edge having at least one second curvature, or the first shield includes an edge having at least one first curvature and the second shield includes an edge having at least one second curvature.

In yet a further embodiment, the present invention broadly comprises a four bar hinge for mounting a door on an enclosure. The hinge includes a first mounting bracket adapted to secure the hinge to the enclosure, a second mounting bracket adapted to secure the hinge to the door, a first link rotationally connected to the first mounting bracket at a first location and rotationally connected to the second mounting bracket at a second location and a second link including a cam, the second link rotationally connected to the first mounting bracket at a third location and rotationally connected to the second mounting bracket at a fourth location. In this embodiment, the cam includes a first curved portion and a second curved portion, wherein the first curved portion has a first curvature, the second curved portion has a second curvature and the first and second curvatures form a continuous surface. Furthermore, this embodiment of the present invention includes a roller biased against the cam thereby imparting a force against the cam and maintaining contact with the cam throughout an entire range of motion of the first mounting bracket relative to the second mounting bracket, a first shield fixedly connected at the second and the fourth locations and a second shield slidably connected to the first link and rotationally connected at the third location, wherein throughout the entire range of motion of the first mounting bracket relative to the second mounting bracket at least a portion of one of the first or second shields overlaps at least a portion of the other of the first and second shields whereby access to a volume formed between the first and second links is precluded.

In some embodiments, the first curvature is substantially the same as the second curvature, while in other embodiments, the first curvature is different than the second curvature. In yet other embodiments, the present invention hinge further includes a rocker arm rotationally connected to the first mounting bracket at a fifth location and a spring having a first end rotationally connected to the first mounting bracket at a sixth location and a second end rotationally connected to the rocker arm at a seventh location, wherein the roller is rotationally connected within the rocker arm at an eighth location and the spring is arranged to bias the roller against the cam. In some of these embodiments, the seventh and eighth locations are positionally different. In still yet other embodiments, the cam is arranged adjacent to the third location and a direction of the force is substantially radial relative to the third location. In still other embodiments, the first shield includes an edge having at least one first curvature, the second shield includes an edge having at least one second curvature, or the first shield includes an edge having at least one first curvature and the second shield includes an edge having at least one second curvature.

It is a general object of the present invention to provide a hinge that both translates and rotates and includes an easily modifiable arrangement of providing biasing forces.

It is another general object of the present invention to provide a hinge having a shielding means that protects against the insertion of objects within the hinge mechanism throughout the hinge's entire range of motion.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
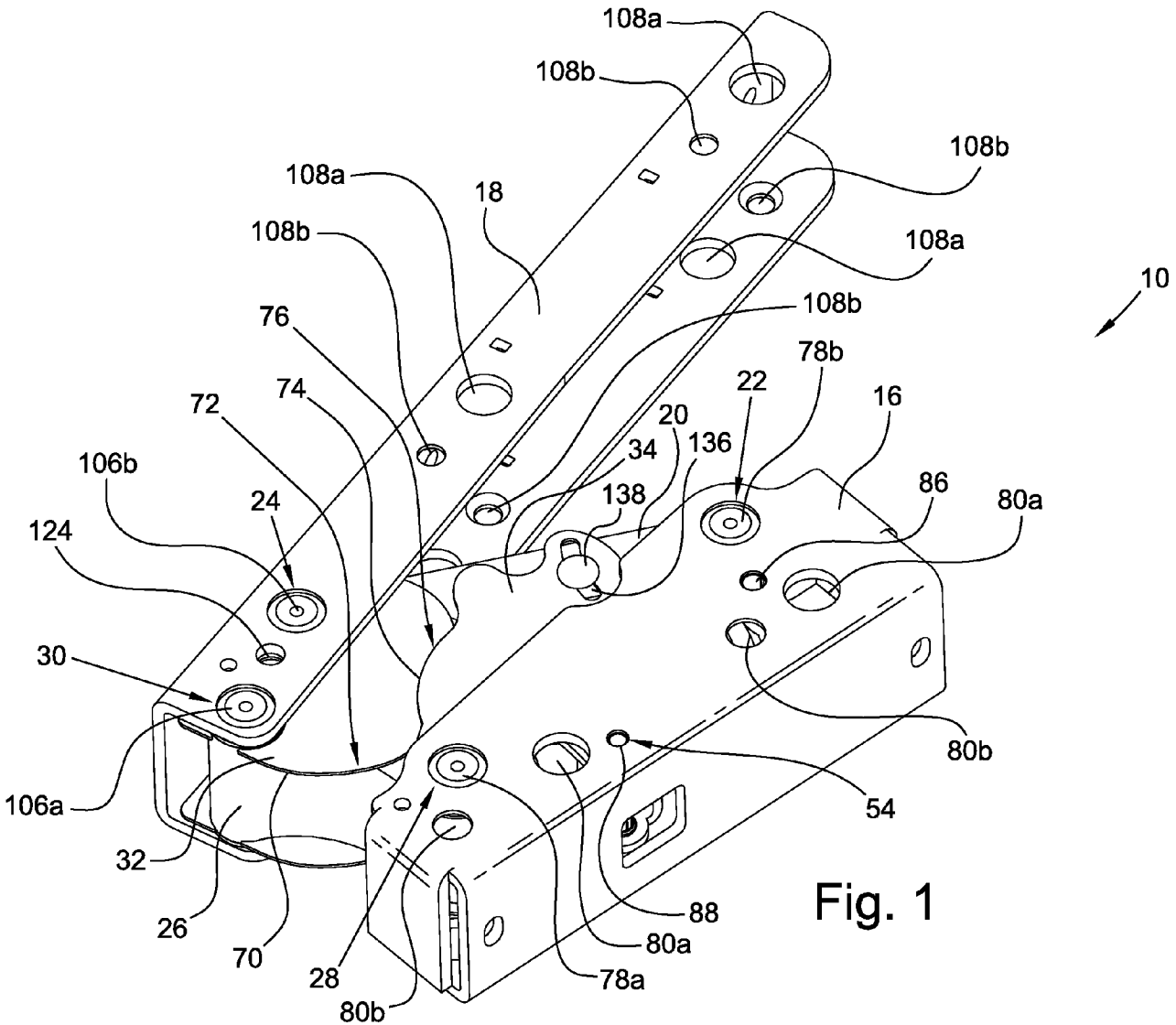
FIG. 1 is a perspective view of an embodiment of the present invention four bar hinge.
Figure 2:
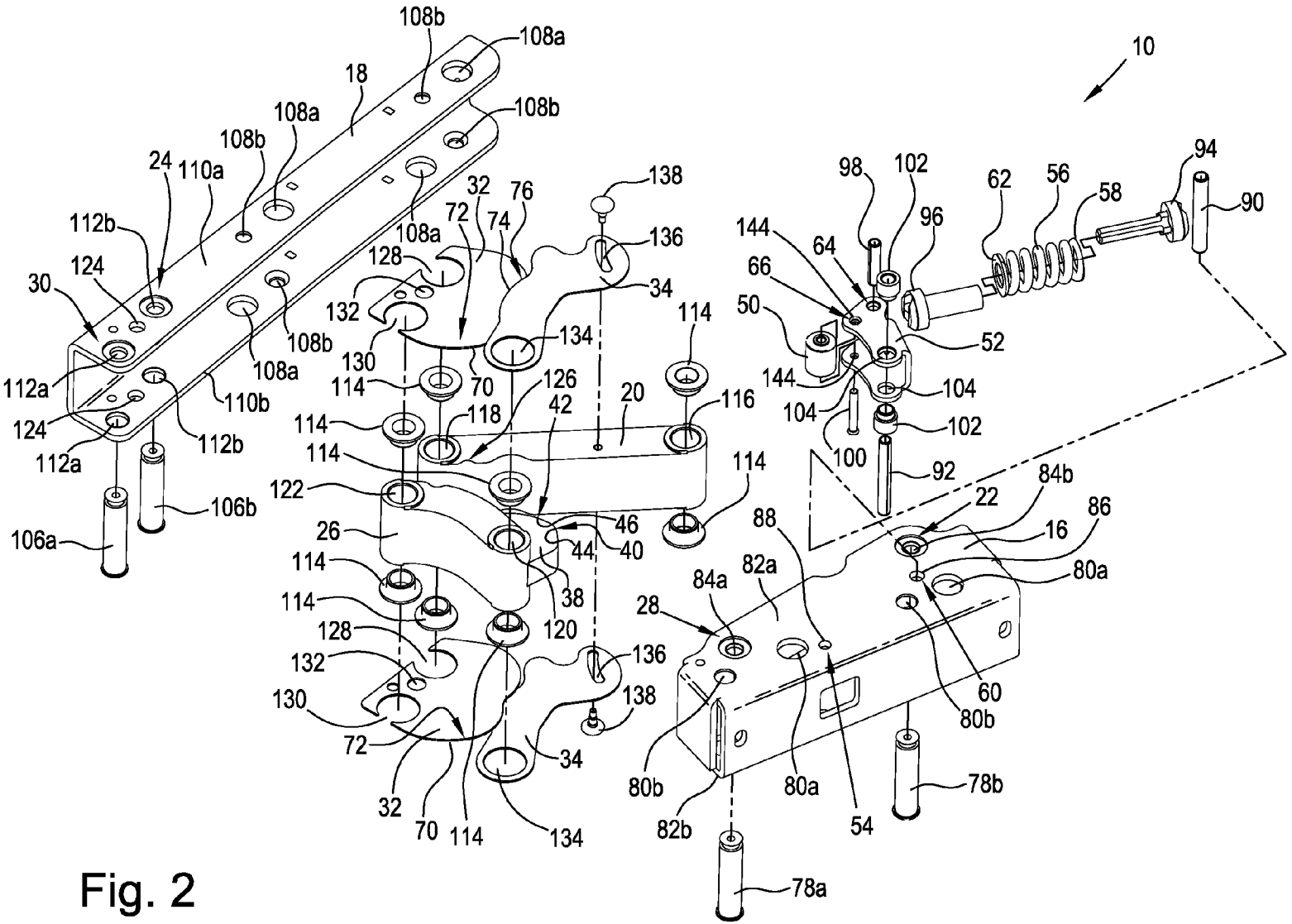
FIG. 2 is an exploded perspective view of an embodiment of the present invention four bar hinge.
Figure 3:
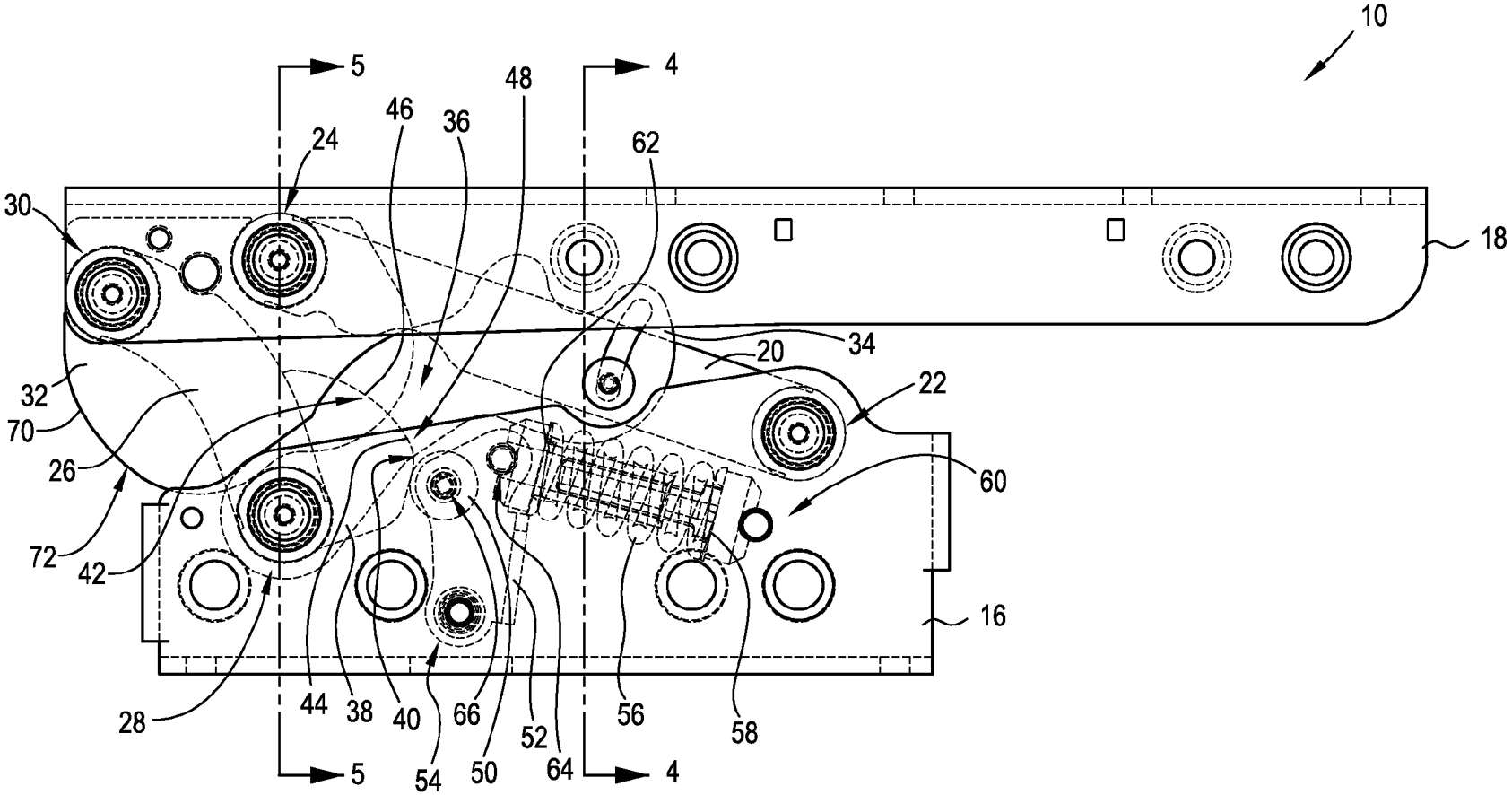
FIG. 3 is a top elevational view of an embodiment of the present invention four bar hinge in a closed position showing inner components in broken lines.
Figure 5:
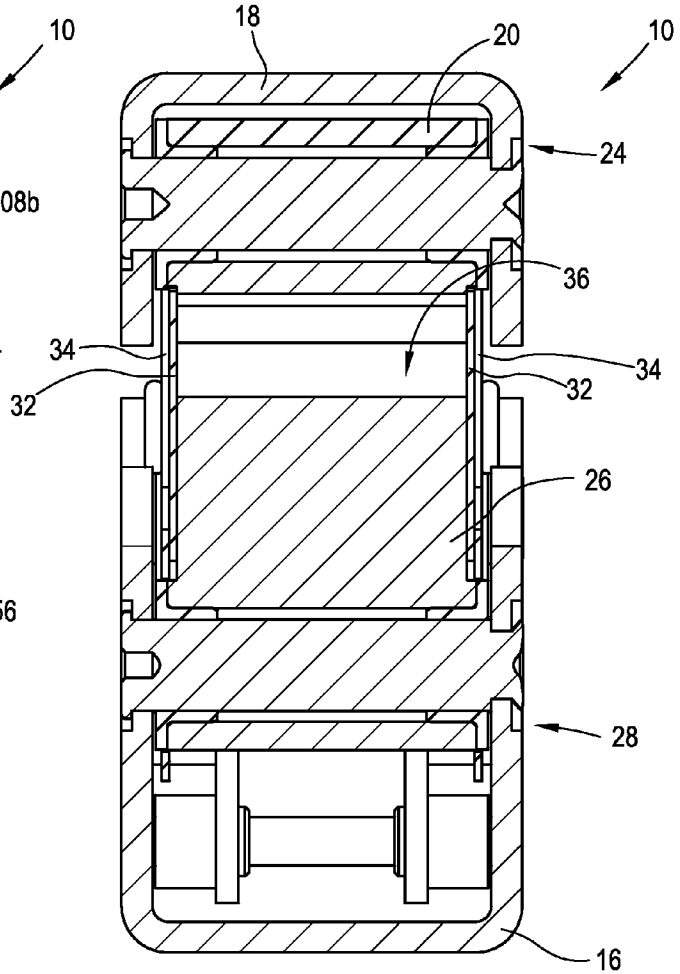
FIG. 5 is a cross-sectional view of an embodiment of the present invention four bar hinge taken generally along line 5-5 of FIG. 3.
Figure 4:
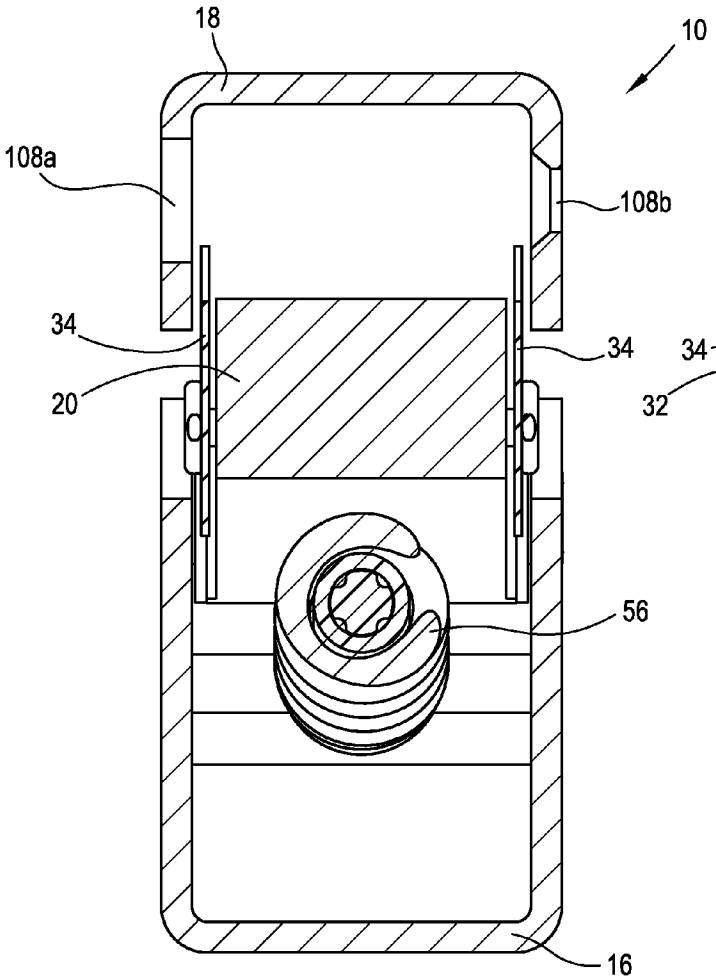
FIG. 4 is a cross-sectional view of an embodiment of the present invention four bar hinge taken generally along line 4-4 of FIG. 3.
Figure 6:
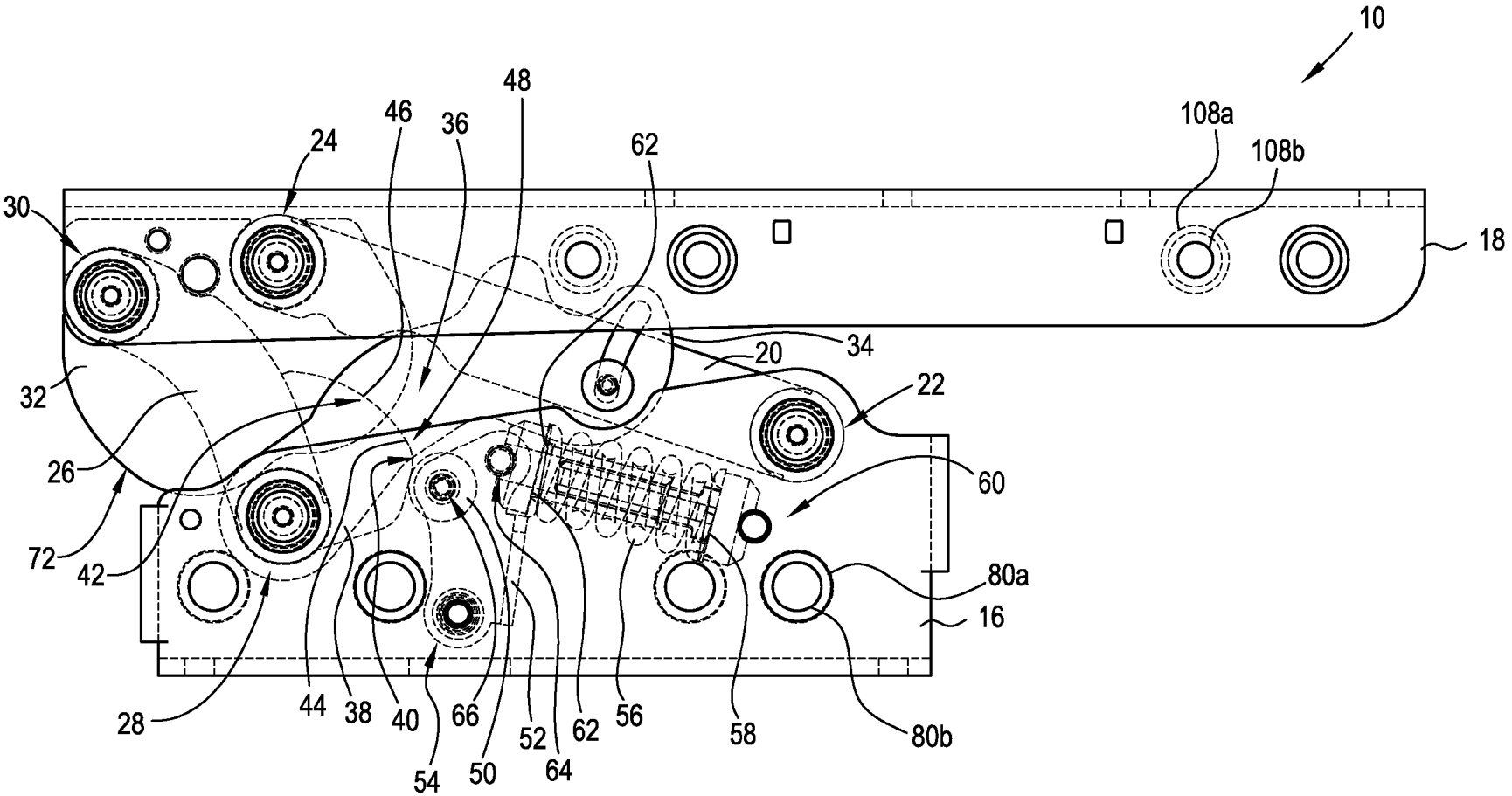
FIG. 6 is a top elevational view of an embodiment of the present invention four bar hinge in a closed position showing inner components in broken lines.
Figure 7:
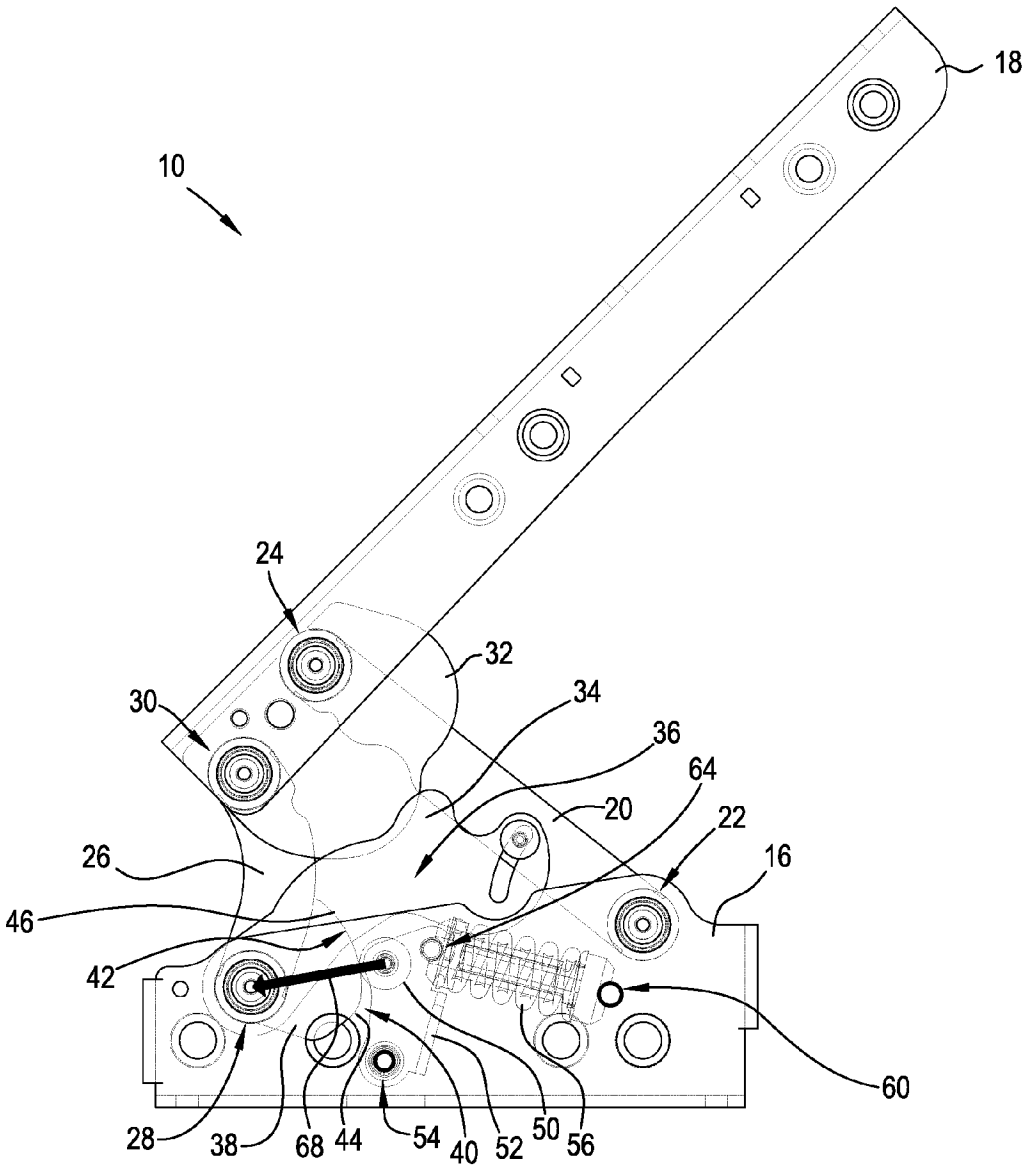
FIG. 7 is a top elevational view of an embodiment of the present invention four bar hinge in a partially opened position showing inner components in broken lines.
Figure 8:
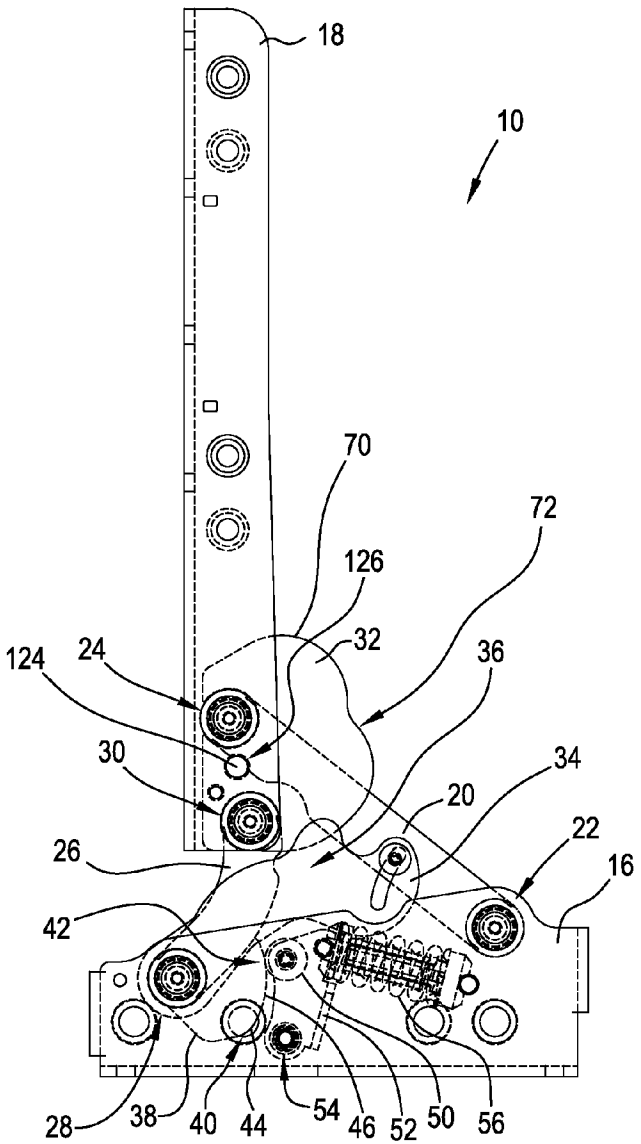
FIG. 8 is a top elevational view of an embodiment of the present invention four bar hinge in another partially opened position showing inner components in broken lines.
Figure 9:
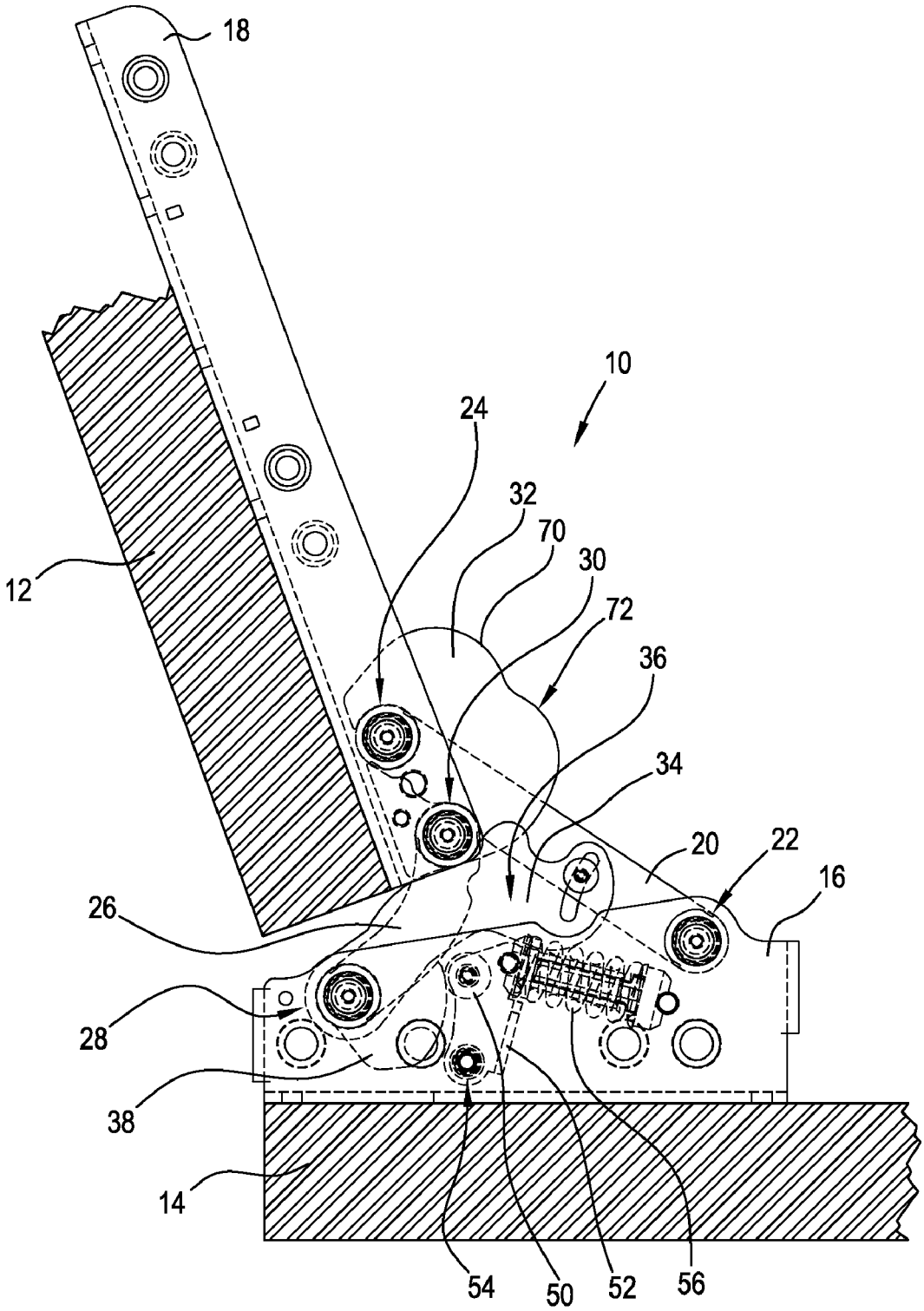
FIG. 9 is a top elevational view of an embodiment of the present invention four bar hinge in a fully opened position showing inner components in broken lines and mounting a door on an enclosure.

Adverting now to the figures, FIG. 1 is a perspective view of an embodiment of the present invention, i.e., four bar hinge 10, while FIG. 2 is an exploded perspective view of four bar hinge 10. FIG. 3 is a top elevational view of four bar hinge 10 in a closed position showing inner components in broken lines, while FIG. 4 is a cross-sectional view of four bar hinge 10 taken generally along line 4-4 of FIG. 3 and FIG. 5 is a cross-sectional view of four bar hinge 10 taken generally along line 5-5 of FIG. 3. FIG. 6 is a top elevational view of four bar hinge 10 in a closed position showing inner components in broken lines. FIG. 7 is a top elevational view of four bar hinge 10 in a partially opened position showing inner components in broken lines, while FIG. 8 is a top elevational view of four bar hinge 10 in another partially opened position showing inner components in broken lines. FIG. 9 is a top elevational view of four bar hinge 10 in a fully opened position showing inner components in broken lines and mounting door 12 on enclosure 14. The following description is best understood in view of FIGS. 1 through 9.

Four bar hinge 10 is adapted for mounting door 12 on enclosure 14. Hinge 10 comprises first mounting bracket 16 adapted to secure hinge 10 to enclosure 14 and second mounting bracket 18 adapted to secure hinge 10 to door 12. Hinge 10 further comprises first link 20 rotationally connected to first mounting bracket 16 at first location 22 and rotationally connected to second mounting bracket 18 at second location 24, and further comprises second link 26 rotationally connected to first mounting bracket 16 at third location 28 and rotationally connected to second mounting bracket 18 at fourth location 30. Moreover, hinge 10 further comprises first shield 32 fixedly connected at second and fourth locations 24 and 30, respectively and second shield 34 slidably connected to first link 20 and rotationally connected at third location 28. As described supra, one of the advantages of the present invention four bar hinge is that throughout an entire range of motion of first mounting bracket 16 relative to second mounting bracket 18, i.e., the range of motion shown in FIGS. 6 through 9, at least a portion of one of first or second shields 32 and 34, respectively, overlaps at least a portion of the other of the first and second shields whereby access to a volume formed between first and second links 20 and 26, respectively, i.e., volume 36, is precluded.

In some embodiments, four bar hinge 10 further comprises cam 38 integral to second link 26. Cam 38 comprises first curved portion 40 and second curved portion 42, wherein first curved portion 40 comprises first curvature 44, second curved portion 42 comprises second curvature 46 and first and second curvatures 44 and 46, respectively, form continuous surface 48. In these embodiments, hinge 10 further comprises roller 50 biased against cam 38 thereby imparting a force against cam 38 and maintaining contact with cam 38 throughout the entire range of motion of first mounting bracket 16 relative to second mounting bracket 18. In some embodiments, first curvature 44 is substantially the same as second curvature 46, while in other embodiments, first curvature 44 is different than second curvature 46. It should be appreciated that the shapes and positions of the curvatures affect the biasing force imparted on the first and second mounting brackets, e.g., some shape/position combinations will result in the first mounting bracket being drawn towards the second mounting bracket (the closing direction), some shape/position combinations will result in the first mounting bracket being pushed away from the second mounting bracket (the opening direction) and some shape/position combinations will result in no biasing force between the first mounting bracket and the second mounting bracket. In other words, different profiles or curvatures change the direction of force transmission between the first and second mounting brackets. In the embodiment shown in the figures, the position and shape of first curved portion 40 results in a biasing force in the closing direction which causes the first mounting bracket to move to a position slightly less than a zero degree position, i.e., over close the hinge, and the position and shape of second curved portion 42 results in a force being applied by roller 50 in the direction of third location 28 thereby resulting in no biasing force in the opening or closing direction. In other words, the cam profile is designed to provide a closing torque to the second link within the kinematics of the four-bar mechanism from a door open angle of approximately twenty degrees, and it is designed to provide a neutral torque condition from a door open angle of approximately thirty degrees to the full open position of one hundred ten degrees. It should be appreciated that FIG. 6 represents an opening angle of about zero degrees, FIG. 7 represents an opening angle of about forty-five degrees, FIG. 8 represents an opening angle of about ninety degrees and FIG. 9 represents an opening angle of about one hundred ten degrees.

It should be further appreciated that cam 38 may take alternate forms than those shown in the figures. For example, cam 38 could include a detent along its surface thereby creating a stopping means. In other words, as roller 50 interacts with the detent, the movement of the first mounting bracket relative to the second mounting bracket is arrested. Furthermore, an additional curved portion having a unique curvature may be position near the end of cam 38 closest to the center of second link 26 and that curvature can provide an opening force thereby pushing the first mounting bracket away from the second mounting bracket. It has been found that the present invention arrangement of cam 38 having its variety of curvature profile configurations results in greater versatility than using a pure linkage arrangement. Biasing forces can be provided in a plurality of directions merely by modifying the curvature of cam 38, and such variations are within the spirit and scope of the claimed invention.

It should be appreciated that various finishes may be used on the cam, e.g., a white powder coat. Such finishes may have very low coefficients of friction against the material used for constructing the roller, e.g., acetal plastic. To keep the roller rolling, instead of tending to slide, along the cam profile, several design features may be implemented. It has been found that if the roller does slide, it wears, and the resultant closing bias on the door is reduced over the anticipated cycle life of a typical hinge of this type which is 300,000 cycles. This result is not desirable. Thus, the ends of the roller have hubs that are a reduced diameter compared to the outer diameter of the roller. This minimizes resistance to rolling from any contact with the inside walls of the rocker arm. Friction from contact at a reduced radius will have a shorter moment arm and hence less torque to resist rolling. The ratio of the outer diameter of the roller compared to the hole diameter in the roller for the supporting rivet should be maximized. Contact between the rivet holding the roller on the rocker arm and the hole diameter of the roller creates friction and torque to resist rolling. Contact between the roller and the cam surface creates friction that causes the roller to roll as the hinge is opened or closed. The contact force between the roller outer diameter (OD) and cam is the same as the contact force between the roller inner diameter (ID) and rivet. The maximum torque to cause the roller to roll is the product of the contact force times the coefficient of friction between the surface finish on the cam and roller OD times the outer radius, i.e., half of roller OD. The resistance to rolling is the product of the contact force times the coefficient of friction between the roller ID and the rivet times the inner radius, i.e., half of hole ID. Therefore, the ratio of the roller OD to the roller ID needs to be greater than the ratio of the coefficient of friction between the roller and the rivet compared to the coefficient of friction between the roller and surface finish of the cam. Less friction between the roller ID and the rivet improves the tendency to roll. More friction between the roller OD and the surface finish of the cam surface improves the tendency to roll. A larger roller OD and/or a smaller roller ID increase the tendency to roll rather than slide. The present invention hinge arrangement has been optimized for these features.

Moreover, the friction between the roller ID and the rivet is minimized by controlling the surface finish on the rivet, e.g., to 50 microinches or less of average roughness. The rivet may be coated with a dry film lubricant, e.g., Emralon®. Such coatings may be applied in three dip and spin coats after the rivet goes through a zinc phosphate finish operation to prepare the surface for the coating. After each of the first two coats the rivets may be heated to dry the film build up. After the third coat they may be cured to a higher temperature and for a longer period to cross link the molecules. It has been found that the foregoing example process generates a low friction, low wear surface while also tending to further smooth the rivet's surface finish. Then the rivets may be lubricated by a dip and spin in a heated solution of high pressure oil. Finally, when the roller and rivet are assembled into the rocker arm, another low friction high pressure grease may be applied to the ID and hub surfaces of the roller.

The roller may be manufactured by a turning operation out of plastic bar stock, e.g., Delrin® 500, rather than by injection molding. This allows the roller to be made with a uniform OD and ID without any taper as is typically required for part ejection in a molding process. It also eliminates any shrink in the part that may be prevalent due to the cross section of the part and mold tool limitations. Uniform diameters and no shrink allow full contact along the length of the OD and ID of the roller to the cam and the rivet, respectively. This loads the rivet in shear as opposed to bending, allowing a smaller diameter rivet. Also, as a turned part, the feed, speed, and cutting tool point shape can be controlled to produce a slight grooved effect, also known as a tire tread, on the roller OD that grips the powder coat surface of the cam. Localized pressure along the higher ridges of the roller OD slightly deform into the surface of the cam's surface finish and grip much as a tire tread grips a road, and thereby provides superior traction compared to alternative surface finishes. Lubrication between the roller OD and the cam surface is minimized by a wiping operation so as not to inadvertently reduce the friction between these components. It should be appreciated that the foregoing examples of roller and cam arrangements describe various embodiments of the present invention and do limit the scope of the claimed invention.

Hinge 10 may also comprise rocker arm 52 rotationally connected to first mounting bracket 16 at fifth location 54 and spring 56 having first end 58 rotationally connected to first mounting bracket 16 at sixth location 60 and second end 62 rotationally connected to rocker arm 52 at seventh location 64. Roller 50 is rotationally connected within rocker arm 52 at eighth location 66 and spring 56 is arranged to bias roller 50 against cam 38. In some embodiments, seventh and eighth locations 64 and 66, respectively, are positionally different (see FIGS. 2 through 9). It should be appreciated that seventh and eighth locations 64 and 66, respectively, may alternatively be positionally the same, e.g., the rotational axis of second end 62 is coaxial with the rotational axis of roller 50. Cam 38 is arranged adjacent to third location 28 and a direction of the force, i.e., the force propagated according to unidirectional arrow 68, is, in particular orientations of the hinge, substantially radial relative to third location 28. In other words, the direction of the force passing from roller 50 to cam 38 may pass through the rotational axis of second link 26.

It should be appreciated that the present invention may also comprise alternate means for positioning roller 50 against cam 38. In other words, the force applied by the roller to the cam profile can be applied without the use of the rocker arm. The force from the compression spring can be directed to the roller and the roller can be held in the correct path by guiding the roller pin in slots in the walls of the first mounting bracket. A side loading, generally perpendicular to the axis of the spring, is generated when the roller rides over the smaller transition radius in the cam profile, i.e., first curved portion 40. Other means of guiding the roller to contact the cam are also possible. For example, a member supporting the roller via a pin can receive the compression spring on its end opposite the roller. The body of the member can be supported to move in a linear fashion, guided by the inside bottom of the first mounting bracket and a rail formed out of each of the two sides of the first mounting bracket, i.e., on the side the member opposite the bottom of the first mounting bracket. A further example includes a plastic member interfacing between the roller/roller pin and the compression spring that is guided via a linear groove in each side of the member. The groove engages a section formed out of the middle of each side of the first mounting bracket. It should be appreciated that in a preferred embodiment, i.e., the embodiment shown in the figures, the rocker arm and roller configuration eliminates any sliding action and associated wear that may not hold up the hundreds of thousands of cycles required by hinges similar to the present invention.

As described supra, at least a portion of one of first or second shields 32 and 34, respectively, overlaps at least a portion of the other of the first and second shields whereby access to a volume formed between first and second links 20 and 26, respectively, i.e., volume 36, is precluded. The means by which first and second shields 32 and 34, respectively, preclude access to volume 36 is by maintaining contact with each other due to the shape of their respective edges. In other words, due to the shapes of the respective edges of first and second shields 32 and 34, respectively, the outer shield, i.e., second shield 34, always at least partially overlaps the inner shield, i.e., first shield 32. Although these shields are shown positioned within the first and second mounting brackets, other arrangements are also possible, e.g., positioning the first and/or second shields outside of the mounting brackets, and such variations are within the spirit and scope of the claimed invention. However, it should be appreciated that due to spatial constraints, in a preferred embodiment, the shields are positioned within the mounting brackets. First shield 32 comprises edge 70 having at least one first curvature 72, while second shield 34 comprises edge 74 having at least one second curvature 76. It should be appreciated that one or both of first and second edges 70 and 74, respectively, may comprise at least one curvature, and that one or both of first and second edges 70 and 74, respectively, may comprise at least one linear portion, and such variations are within the spirit and the scope of the claimed invention. The seemingly odd edge shapes are arranged to keep the first and second shields always in an overlap condition so that they do not flex and/or contact edge to edge during opening and closing of the hinge as well as to cover the open areas where a finger or other object might get pinched. With the foregoing arrangement, any opening size will not exceed ¼" diameter. Other edge features, e.g., indents or cutaways, provide clearance as needed with other hinge components in various positions as the hinge goes through it motion. As shown in the figures and in the preferred embodiment of the present invention, hinge 10 includes first and second shields 32 and 34, respectively, positioned on both sides of the hinge. However, other embodiments are also possible, e.g., first and second shields 32 and 34, respectively, positioned on only one side of hinge 10, and such variations are within the spirit and scope of the claimed invention.

It should be appreciated in view of the foregoing, that the present invention has a variety of embodiments. For example, the present invention, i.e., four bar hinge 10, which is adapted for mounting door 12 on enclosure 14, comprises first mounting bracket 16 adapted to secure hinge 10 to enclosure 14, second mounting bracket 18 adapted to secure hinge 10 to door 12, first link 20 rotationally connected to first mounting bracket 16 at first location 22 and rotationally connected to second mounting bracket 18 at second location 24 and second link 26 comprising cam 38, second link 26 rotationally connected to first mounting bracket 16 at third location 28 and rotationally connected to second mounting bracket 18 at fourth location 30. In this embodiment, cam 38 comprises first curved portion 40 and second curved portion 42, wherein first curved portion 40 comprises first curvature 44, second curved portion 42 comprises second curvature 46 and first and second curvatures 44 and 46, respectively, form continuous surface 48. Moreover, in this embodiment, hinge 10 further comprises roller 50 biased against cam 38 thereby imparting a force, i.e., a force in the direction of and shown by uni-directional arrow 68, against cam 38 and maintaining contact with cam 38 throughout an entire range of motion of first mounting bracket 16 relative to second mounting bracket 18.

Moreover, the present invention may comprise another embodiment. For example, the present invention, i.e., four bar hinge 10, which is adapted for mounting door 12 on enclosure 14, may comprise first mounting bracket 16 adapted to secure hinge 10 to enclosure 14, second mounting bracket 18 adapted to secure hinge 10 to door 12, first link 20 rotationally connected to first mounting bracket 16 at first location 22 and rotationally connected to second mounting bracket 18 at second location 24 and second link 26 comprising cam 38, second link 26 rotationally connected to first mounting bracket 16 at third location 28 and rotationally connected to second mounting bracket 18 at fourth location 30. In this embodiment, cam 38 comprises first curved portion 40 and second curved portion 42, wherein first curved portion 40 comprises first curvature 44, second curved portion 42 comprises second curvature 46 and first and second curvatures 44 and 46, respectively, form continuous surface 48, and hinge 10 further comprises roller 50 biased against cam 38 thereby imparting a force, i.e., a force in the direction of and shown by uni-directional arrow 68, against cam 38 and maintaining contact with cam 38 throughout an entire range of motion of first mounting bracket 16 relative to second mounting bracket 18. Moreover, in this embodiment, hinge 10 still further comprises first shield 32 fixedly connected at second and fourth locations 24 and 30, respectively and second shield 34 slidably connected to first link 20 and rotationally connected at third location 28, wherein throughout the entire range of motion of first mounting bracket 16 relative to second mounting bracket 18 at least a portion of one of first or second shields 32 and 34, respectively, overlaps at least a portion of the other of the first and second shields whereby access to volume 36 formed between first and second links 20 and 26, respectively, is precluded.

In view of the foregoing description of the present invention, the following discussion is best understood in view FIGS. 1 through 9. As described supra, first mounting bracket 16 is adapted to be mounted to enclosure 14. First mounting bracket 16 includes a plurality of through holes arranged to secure the bracket to enclosure 14 and a plurality of through holes arranged to receive press/pivot pins 78*a* and 78*b*. Through holes 80*a* and 80*b* are oppositely disposed so that a tool adapted to interface with a fastener may pass through holes 80*a* and secure a fastener arranged within holes 80*b* thereby securing first mounting bracket 16 to enclosure 14. It should be appreciated that first mounting bracket 16 includes through holes 80*a* and 80*b* arranged in adjacent configurations so that first mounting bracket 16 may be secured to enclosure 14 from either side 82*a* or 82*b*. Through holes 84*a* and 84*b* are adapted to receive pivot pins 78*a* and 78*b* whereby first and second links 20 and 26, respectively, are rotatably secured, i.e., at first and third locations 22 and 28, respectively. Furthermore, first mounting bracket 16 includes through holes 86 and 88 arranged to receive pivot pins 90 and 92, respectively. Pivot pin 90 provides a pivot point for male spring guide 94 and thereby compression spring 56, while pivot pin 92 provides a pivot point for rocker arm 52. Compression spring 56 pushes outwardly thereby separating male spring guide 94 from female spring guide 96 and in turn pushes roller 50 against cam 38 via contact between female spring guide 96 and pin 98, pin 98 and rocker arm 52 and rocker arm 52 and roller 50 via roller rivet pin 100. To facilitate the rotation of rocker arm 52 about pin 92, bushings 102 are inserted within through holes 104.

Similar to first mounting bracket 16, second mounting bracket 18 includes a plurality of through holes arranged to secure the bracket to door 12 and a plurality of through holes arranged to receive press/pivot pins 106*a* and 106*b*. Through holes 108*a* and 108*b* are oppositely disposed so that a tool adapted to interface with a fastener may pass through holes 108*a* and secure a fastener arranged within holes 108*b* thereby securing second mounting bracket 18 to door 12. It should be appreciated that second mounting bracket 18 includes through holes 108*a* and 108*b* arranged in adjacent configurations so that second mounting bracket 18 may be secured to door 12 from either side 110*a* or 110*b*. Through holes 112*a* and 112*b* are adapted to receive pivot pins 106*a* and 106*b* whereby first and second links 20 and 26, respectively, are rotatably secured, i.e., at second and fourth locations 24 and 30, respectively. As can be seen in the figures, the rotation of first and second links 20 and 26, respectively, is facilitated by arranging flange bushings 114 within openings 116, 118, 120 and 122 and about pivot pins 78*b*, 106*b*, 78*a* and 106*a*, respectively. It should be appreciated that second mounting bracket 18 further includes through holes 124 oppositely disposed and arranged to receive a pin (not shown) inserted therein. By inserting a pin within holes 124, the extent of rotation of second mounting bracket 18 relative to first mounting bracket 16 is limited to approximately ninety degrees (See FIG. 8), as opposed to the approximate one hundred five to one hundred ten degrees of rotation shown in FIG. 9, i.e., the pin interfaces with notch 126 in first link 20. It should be appreciated that the arrangement of through holes 108*a* and 108*b* are structurally similar to the arrangement of through holes 80*a* and 80*b*. Therefore, although through holes 80*a* and 80*b* on side 82*b* are obscured from view their respective arrangements are similar to the arrangements of through 108*a* and 108*b*.

First shield 32 having openings 128 and 130 is fixedly secured to pivot pins 106*b* and 106*a*, respectively, so that as second mounting bracket 18 is pivoted, first shield 32 remains positionally fixed relative to second mounting bracket 18. First shield 32 further includes opening 132 aligned with holes 124 thereby permitting insertion of a pin therein as described supra. Second shield 34 includes opening 134 adapted to rotationally mount second shield 34 to pivot pin 78*a*. Second shield 34 further includes arcuate slot 136 adapted to slidably connected second shield 34 to first link 20 via rivet 138. Thus, as second mounting bracket 18 rotates relative to first mounting bracket 16, second shield 34 rotates about third location 28 while translating relative to rivet 138. It should be appreciated that it is this arrangement of securing first and second shields 32 and 34, respectively, which permits the continuous overlap of one shield over the other throughout the entire range of motion of first mounting bracket 16 relative to second mounting bracket 18.

Figure 10:
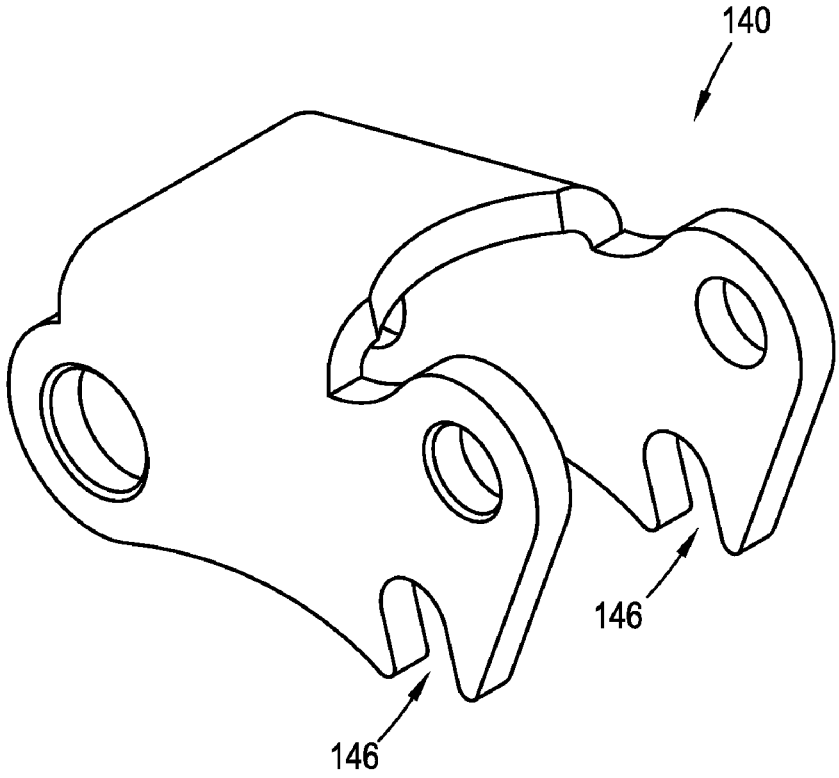
FIG. 10 is a perspective view of another embodiment of rocker arm for use in the present invention four bar hinge; and, FIG. 11 is a perspective view of another embodiment of a roller rivet for use with the rocker arm shown in FIG. 10.
Figure 11:
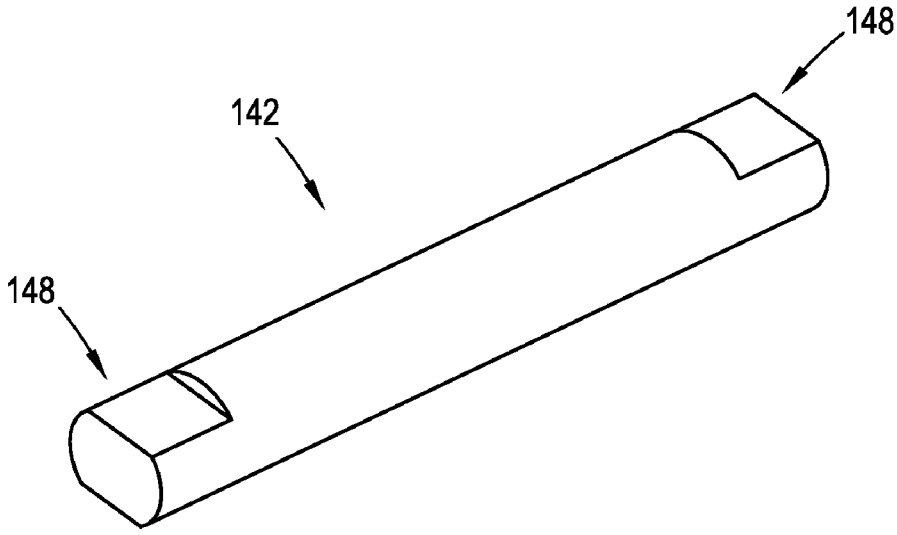

FIG. 10 shows a perspective view of another embodiment of a rocker arm for use in the present invention four bar hinge, i.e., rocker arm 140, while FIG. 11 shows a perspective view of another embodiment of a roller rivet for use with rocker arm 140, i.e., roller rivet 142. The following is best understood in view of FIGS. 1 through 11. The performance of the present invention is in part dependent on the consistent and repeatable rotation of roller 50 on cam 38. When installing roller 50 on rocker arm 52 with rivet pin 100, the rivet forming process may deform pin 100 so that it no longer remains linear in the region arranged within roller 50. Such deformation hinders the proper rotation of roller 50 on cam 38 thereby affecting the performance of hinge 10. Rocker arm 140 and roller rivet 142 shown in FIGS. 10 and 11 provide an alternate embodiment by which roller 50 may interact with the rocker arm. Oppositely disposed through holes 144 of rocker arm 52 have been replaced by oppositely disposed slots 146 in rocker arm 140. Roller rivet 142 having notched ends 148 is arranged within roller 50, i.e., coaxially, and notched ends 148 are arranged within slots 146. As roller rivet 142 does not need to be formed within slots 146, it is less likely that roller rivet 142 will become deformed during assembly. Thus, including rocker arm 140 and roller rivet 142 in hinge provides an alternate arrangement for rotationally connecting roller 50 to rocker arm 140.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. A four bar hinge for mounting a door on an enclosure, said hinge comprising:

a first mounting bracket adapted to secure said hinge to said enclosure;

a second mounting bracket adapted to secure said hinge to said door;

a first link rotationally connected to said first mounting bracket at a first location and rotationally connected to said second mounting bracket at a second location;

a second link rotationally connected to said first mounting bracket at a third location and rotationally connected to said second mounting bracket at a fourth location;

a first shield fixedly connected at said second and said fourth locations; and, a second shield slidably connected to said first link and rotationally connected at said third location, wherein throughout an entire range of motion of said first mounting bracket relative to said second mounting bracket at least a portion of one of said first or second shields overlaps and contacts at least a portion of the other of said first and second shields whereby access to a volume formed between said first and second links is precluded from a first side of said volume, wherein the first and second shields are positioned within the first and second mounting brackets, wherein either said first shield comprises an edge having at least one first curvature or said second shield comprises an edge having at least one second curvature, or said first shield comprises an edge having at least one first curvature and said second shield comprises an edge having at least one second curvature.

2. The four bar hinge of claim 1 further comprising:

a cam integral to said second link, said cam comprising a first curved portion and a second curved portion, wherein said first curved portion comprises a first curvature, said second curved portion comprises a second curvature and said first and second curvatures form a continuous surface; and, a roller biased against said cam thereby imparting a force against said cam and maintaining contact with said cam throughout said entire range of motion of said first mounting bracket relative to said second mounting bracket.

3. The four bar hinge of claim 2 wherein said first curvature is substantially the same as said second curvature.

4. The four bar hinge of claim 2 wherein said first curvature is different than said second curvature.

5. The four bar hinge of claim 2 further comprising:

a rocker arm rotationally connected to said first mounting bracket at a fifth location; and, a spring having a first end rotationally connected to said first mounting bracket at a sixth location and a second end rotationally connected to said rocker arm at a seventh location, wherein said roller is rotationally connected within said rocker arm at an eighth location and said spring is arranged to bias said roller against said cam.

6. The four bar hinge of claim 5 wherein said seventh and eighth locations are positionally different.

7. The four bar hinge of claim 2 wherein said cam is arranged adjacent to said third location and a direction of said force is substantially radial relative to said third location.

8. A four bar hinge for mounting a door on an enclosure, said hinge comprising:

a first mounting bracket adapted to secure said hinge to said enclosure;

a second mounting bracket adapted to secure said hinge to said door;

a first link rotationally connected to said first mounting bracket at a first location and rotationally connected to said second mounting bracket at a second location;

a second link comprising a cam, said second link rotationally connected to said first mounting bracket at a third location and rotationally connected to said second mounting bracket at a fourth location;

said cam comprising a first curved portion and a second curved portion, wherein said first curved portion comprises a first curvature, said second curved portion comprises a second curvature and said first and second curvatures form a continuous surface;

a roller biased against said cam thereby imparting a force against said cam and maintaining contact with said cam throughout an entire range of motion of said first mounting bracket relative to said second mounting bracket;

a first shield fixedly connected at said second and said fourth locations; and, a second shield slidably connected to said first link and rotationally connected at said third location, wherein throughout said entire range of motion of said first mounting bracket relative to said second mounting bracket at least a portion of one of said first or second shields overlaps and contacts at least a portion of the other of said first and second shields whereby access to a volume formed between said first and second links is precluded from a first side of said volume, wherein the first and second shields are positioned within the first and second mounting brackets, wherein either said first shield comprises an edge having at least one first curvature or said second shield comprises an edge having at least one second curvature, or said first shield comprises an edge having at least one first curvature and said second shield comprises an edge having at least one second curvature.

9. The four bar hinge of claim 8 wherein said first curvature is substantially the same as said second curvature.

10. The four bar hinge of claim 8 wherein said first curvature is different than said second curvature.

11. The four bar hinge of claim 8 further comprising:

a rocker arm rotationally connected to said first mounting bracket at a fifth location; and, a spring having a first end rotationally connected to said first mounting bracket at a sixth location and a second end rotationally connected to said rocker arm at a seventh location, wherein said roller is rotationally connected within said rocker arm at an eighth location and said spring is arranged to bias said roller against said cam.

12. The four bar hinge of claim 11 wherein said seventh and eighth locations are positionally different.

13. The four bar hinge of claim 8 wherein said cam is arranged adjacent to said third location and a direction of said force is substantially radial relative to said third location.

14. The four bar hinge of claim 1 further comprising:

a third shield fixedly connected at said second and said fourth locations; and, a fourth shield slidably connected to said first link and rotationally connected at said third location, wherein throughout an entire range of motion of said first mounting bracket relative to said second mounting bracket at least a portion of one of said third or fourth shields overlaps and contacts at least a portion of the other of said third and fourth shields whereby access to said volume is precluded from a second side of said volume.

15. The four bar hinge of claim 8 further comprising:

a third shield fixedly connected at said second and said fourth locations; and, a fourth shield slidably connected to said first link and rotationally connected at said third location, wherein throughout an entire range of motion of said first mounting bracket relative to said second mounting bracket at least a portion of one of said third or fourth shields overlaps and contacts at least a portion of the other of said third and fourth shields whereby access to said volume is precluded from a second side of said volume.

* * * * *